US007670175B2

(12) United States Patent
Suzuki et al.

(10) Patent No.: US 7,670,175 B2
(45) Date of Patent: Mar. 2, 2010

(54) MOVABLE CONNECTOR

(75) Inventors: Shinobu Suzuki, Makinohara (JP); Masakuni Samejima, Makinohara (JP); Norio Sugiyama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 10 days.

(21) Appl. No.: 11/599,418

(22) Filed: Nov. 15, 2006

(65) Prior Publication Data

US 2007/0117454 A1 May 24, 2007

(30) Foreign Application Priority Data

Nov. 18, 2005 (JP) ..... P2005-334456

(51) Int. Cl.
*H01R 9/05* (2006.01)

(52) U.S. Cl. ..... 439/578

(58) Field of Classification Search ..... 439/578, 439/580, 581, 582, 247, 248
See application file for complete search history.

(56) References Cited

U.S. PATENT DOCUMENTS 3,951,500 A * 4/1976 Anderson ..... 439/248
4,277,135 A * 7/1981 Schrott et al. ..... 385/75
4,342,496 A * 8/1982 Hutter et al. ..... 439/578
4,580,862 A * 4/1986 Johnson ..... 439/248
4,697,859 A * 10/1987 Fisher, Jr. ..... 439/246
5,135,408 A * 8/1992 Suzuki ..... 439/310
5,137,469 A * 8/1992 Carpenter et al. ..... 439/578
5,167,520 A * 12/1992 Henry et al. ..... 439/266
5,329,262 A * 7/1994 Fisher, Jr. ..... 333/33
5,376,014 A * 12/1994 Sumida ..... 439/310
5,514,000 A * 5/1996 Krause et al. ..... 439/248
5,605,150 A * 2/1997 Radons et al. ..... 600/300
5,649,747 A * 7/1997 Naito et al. ..... 303/113.5
5,769,652 A * 6/1998 Wider ..... 439/248
5,931,698 A * 8/1999 Kodama ..... 439/578
5,997,334 A * 12/1999 Goto ..... 439/352
6,155,857 A * 12/2000 Kato et al. ..... 439/248
6,159,019 A * 12/2000 Norizuki et al. ..... 439/34
6,354,855 B2 * 3/2002 Annequin ..... 439/248
6,422,885 B2 * 7/2002 Kain et al. ..... 439/247
6,592,268 B2 * 7/2003 Chen et al. ..... 385/88
6,592,387 B2 * 7/2003 Komenda et al. ..... 439/247
6,699,054 B1 * 3/2004 Critelli ..... 439/248
6,746,267 B2 * 6/2004 Fukamachi et al. ..... 439/374
6,824,403 B2 * 11/2004 Hall et al. ..... 439/108
6,908,326 B2 * 6/2005 Shiota et al. ..... 439/247
2005/0037666 A1 * 2/2005 Konda ..... 439/607
2005/0250382 A1 * 11/2005 Mourad et al. ..... 439/578

FOREIGN PATENT DOCUMENTS

JP 9-073950 A 3/1997

* cited by examiner

*Primary Examiner*—T C Patel
*Assistant Examiner*—Vladimir Imas
(74) *Attorney, Agent, or Firm*—Sughrue Mion, PLLC

(57) ABSTRACT

A movable connector includes a first member, a second member that is adapted to be fixed to the first member, a first connector that is fixed to the first member, a holder that is integrally formed on the second member, and a second connector that is provided within the holder so as to move in a first direction perpendicular to a second direction in which the first connector is connected to the second connector. The first connector is connected to the second connector in accordance with an operation for fixing the first member to the second member.

6 Claims, 10 Drawing Sheets

MOVABLE CONNECTOR

BACKGROUND OF THE INVENTION

This invention relates to a movable connector.

In a vehicle such as an automobile, connectors to be connected together are often provided respectively at two members which are fixed to each other. One of the two members is, for example, an equipment such as one of various units or an instrument panel, while the other member is, for example, a mounting panel on a vehicle body.

For example, when an instrument panel (attachment member) is to be mounted on a mounting panel (mounting member), one connector is, in some cases, fixedly mounted on the mounting panel, while the other connector is mounted on the instrument panel. The two connectors are so provided that when the instrument panel is fixedly mounted at a predetermined portion of the mounting panel, the two connectors can be positioned relative to each other, and can be properly fitted together. Therefore, when mounting the instrument panel, the two connectors are broadly positioned relative to each other so that they can be properly fitted together, and in this condition the instrument panel is fixed to the mounting panel by screws or the like, thereby fitting the two connectors together.

However, the above related connectors can be properly fitted together only when the attachment member is properly fixed to the mounting member. Therefore, when the instrument panel is not properly fixed to the mounting panel, for example, because of a mounting error or the like, the two connectors, in some cases, fail to be properly fitted together, and this has led to a possibility that defective contact due to the incompletely-fitted condition develops.

There is known a movable connector which can solve the above problem (see, for example, JP-A-9-73950).

FIGS. 13 and 14 are views showing the construction of the related movable connector disclosed in JP-A-9-73950. This movable connector includes a first connector 130 to be fixed to a first member (not shown)) which is one of two members to be fixed to each other, a holder 110 for mounting on the second member, and a second connector 120 movably mounted within the holder 110. Before the first and second members are completely fixed to each other, the second connector 120 is provisionally locked to the holder 110. In accordance of the movement of the first member toward the second member, the second connector 120 is fitted into the first connector 130. The second connector 120 can be moved within the holder 110 by an amount corresponding to an amount of movement of the first member relative to the second member before this first member is brought into completely-fixed relation to the second member. The provisionally-locked condition is achieved by engaging lock projections 121 (formed respectively on right and left side surfaces of the second connector 120) respectively in lock holes 111 in the holder 110 and also by engaging lock projections 122 (formed respectively on upper and lower surfaces of the second connector 120) respectively with lock projections 112 on an inner surface of the holder 110.

In the movable connector of this construction, when the first connector 130 is inserted relative to the second connector 120 attached to the holder 110, the first connector 130 is fitted on the second connector 120 provisionally locked to the holder 110. Then, when the attachment member (not shown), having the first connector 130 fixedly mounted thereon, is fixed to the mounting member, having the holder 110 mounted thereon, after the second connector 120 and the first connector 130 are completely fitted together, the first connector 130 is further pushed into the holder 110, so that the provisionally-locked condition of the second connector 120 and holder 110 is canceled, and the second connector 120 is further pushed rearward relative to the holder 110 by a pressing force of the first connector 130. Namely, at the time of finally fixing the attachment member, the connectors 120 and 130 already completely fitted together are pushed rearward relative to the holder 110 by an amount of movement of the attachment member.

Thus, the first connector 130 and the second connector 120 are completely fitted together before the attachment member and the mounting member are completely fixed to each other, and therefore even when the attachment member and the mounting member are not completely fixed to each other, the two connectors are positively kept in the completely-fitted condition.

In the related movable connector disclosed in JP-A-9-73950, the second connector 120 must be inserted into the holder 110 to be provisionally locked thereto after the holder 110 is mounted on the mounting member, and if this mounting operation can be carried out more easily, this is desirable. And besides, in the movable connector of JP-A-9-73950, the separate holder 110 must be prepared, so that the number of the component parts increases, and therefore it is desirable to reduce the cost by some means. Furthermore, in the movable connector of JP-A-9-73950, although the second connector 120 is movable within the holder 110, the second connector 120 can move freely only in the connector fitting direction, and therefore if the shifting of the connector in a direction perpendicular to the connector fitting direction can be absorbed, this is more desirable. Namely, for example, there are occasions when the two connectors are disposed out of alignment with each other, that is, shifted relative to each other in a direction perpendicular to the connector fitting direction, at the time of fixing the attachment member to the mounting member, and in this case if terminals of the two connectors can be prevented from unnecessarily striking against each other, and unnecessary stresses due to such undue striking action do not act on these terminals, this is more desirable.

SUMMARY OF THE INVENTION

This invention has been made in view of the above circumstances, and an object of the invention is to provide a movable connector in which simultaneously when a first member and a second member (that is, an attachment member and a mounting member) are fixed to each other, two connectors fixed respectively to the two members can be positively and easily fitted to each other.

In order to achieve the above object, according to the present invention, there is provided a movable connector, comprising:

a first member;

a second member that is adapted to be fixed to the first member;

a first connector that is fixed to the first member;

a holder that is integrally formed on the second member; and a second connector that is provided within the holder so as to move in a first direction perpendicular to a second direction in which the first connector is connected to the second connector, wherein the first connector is connected to the second connector in accordance with an operation for fixing the first member to the second member.

Preferably, the second connector is provided within the holder so as to have an air gap between the second connector and the holder.

Preferably, a first retaining portion of the second connector is retained to a second retaining portion of the holder so as to restrict movement of the second connector with respect to the holder in the second direction.

Here, it is preferable that, the second connector contacts the holder at only an area in which the first retaining portion is retained to the second retaining portion.

In the above configuration, the holder, holding the second connector in a manner to allow the movement thereof, is molded integrally on the second member, and therefore any time and labor are not required for mounting the holder on the second member, and therefore such additional step can be omitted. And besides, in the movable connector, there is no need to prepare the holder in the form of a separate member, and therefore the number of the component parts is reduced, which contributes to the reduction of the cost. Furthermore, in the movable connector, the second connector is held within the holder so as to move in a direction perpendicular to the axis of the holder, and therefore even if the two connectors are disposed out of alignment with each other, that is, shifted relative to each other in a direction perpendicular to the axis of the holder, at the time of fixing the first and second members to each other, the second connector moves in accordance with the operation for connecting the first and second connectors together, thereby absorbing this misalignment, and therefore the two connectors can be positively and easily fitted together.

Preferably, a guide projection is provided on one of the first connector and the second connector so as to project in the second direction. A guide hole is provided in the other of the first and second connectors. The guide projection is slidingly fitted into the guide hole so that the first and second connectors are positioned to each other.

In the above configuration, when connecting the first and second connectors together, the guide projection is slidingly fitted into the guide hole, thereby guiding the connection between terminals of the first connector and the terminals of the second connector. Therefore, the terminals of the first connector are prevented from striking against the terminals of the second connector, and can be smoothly fitted respectively to the corresponding terminals.

Preferably, the movable connector further comprises a terminal that is inserted in the second connector. A rear end portion of the terminal includes a buffer portion which absorbs displacement of the terminal due to movement of the second connector within the holder, and a joint portion which is adapted to joint a circuit board.

In the above configuration, the joint portions for the circuit board are provided respectively at the rear end portions of the terminals of the second connector through the respective buffer portions for absorbing displacement of the respective terminals due to movement of the second connector within the holder, and therefore even if the second connector moves so as to absorb misalignment, undue stresses will not act on the joint portions of the terminals for the circuit board, and the quality can be stabilized.

In the movable connector of the present invention, simultaneously when the first member and the second member (that is, the attachment member and the mounting member) are fixed to each other, the two connectors fixed respectively to the two members can be positively and easily fitted to each other.

The present invention has been briefly described above. Details of the invention will become more manifest upon reading the following Section "Best Mode for Carrying Out the Invention" with reference to the accompanying drawings.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A preferred embodiment of the present invention will now be described in detail with reference to the drawings.

Figure 1:
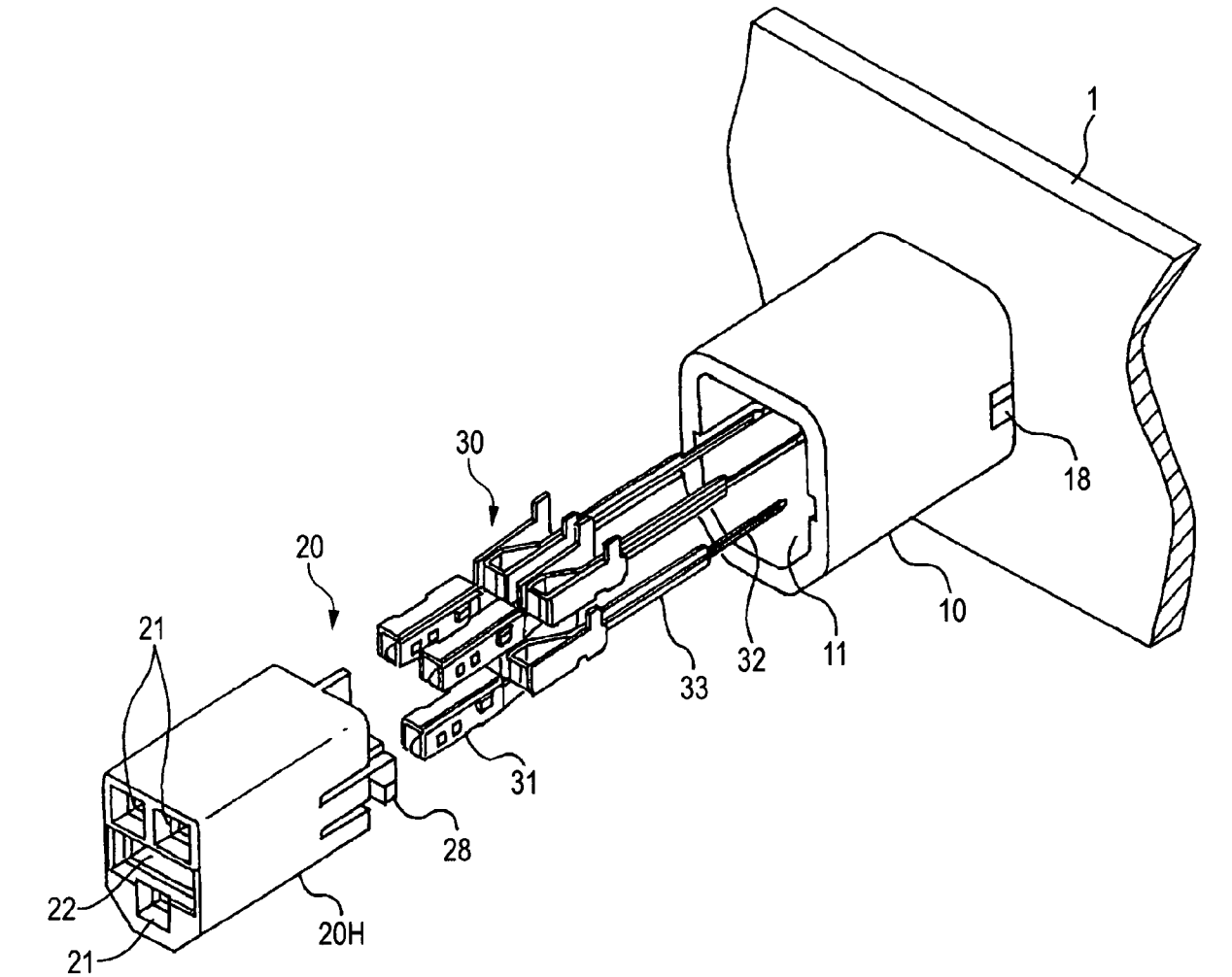
FIG. 1 is a view explanatory of a preferred embodiment of the present invention, and more specifically is an exploded, perspective view showing the relation between a case (that is, a second member), a holder and a female connector (that is a second connector)
Figure 2:
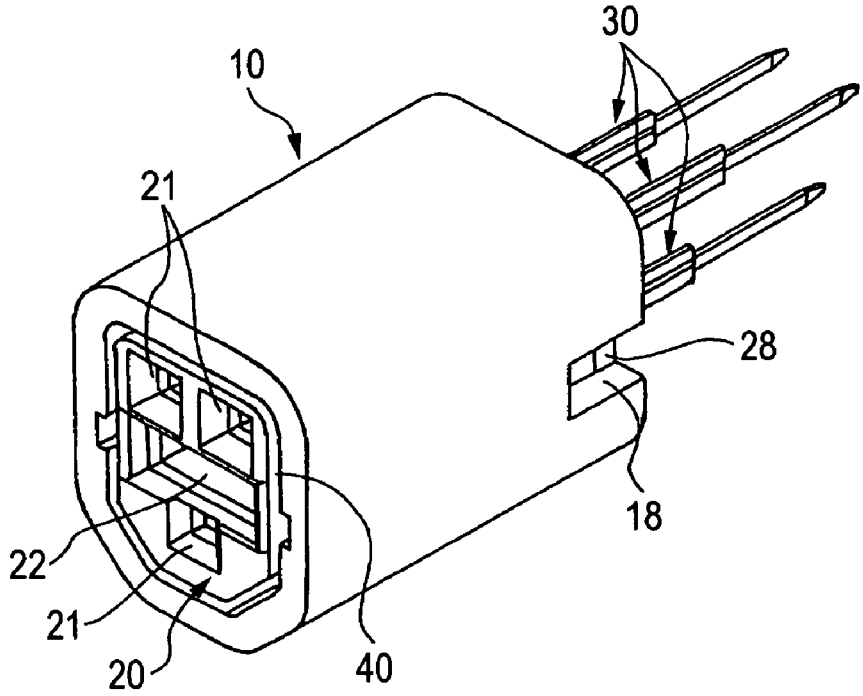
FIG. 2 is a perspective view showing a condition in which the female connector is mounted within the holder, with the showing of the case omitted.
Figure 3:
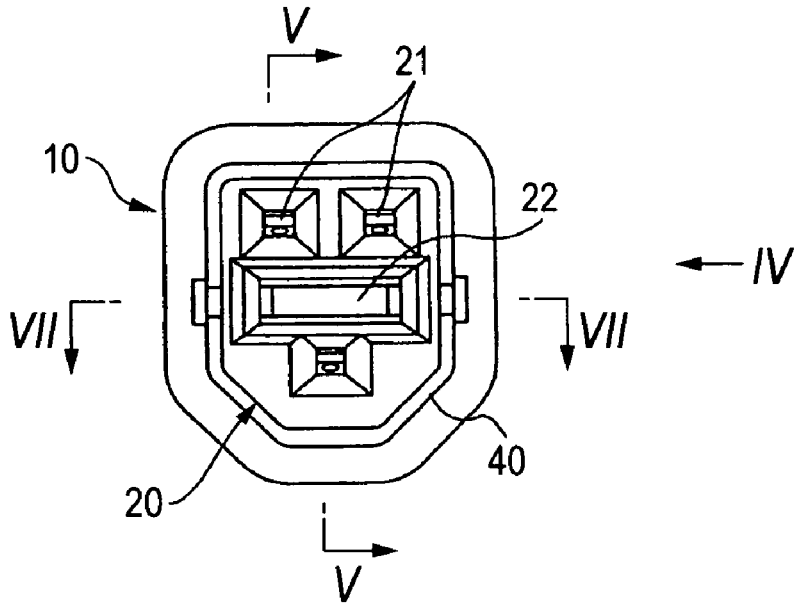
FIG. 3 is a front-elevational view of the holder having the female connector mounted therein.
Figure 4:
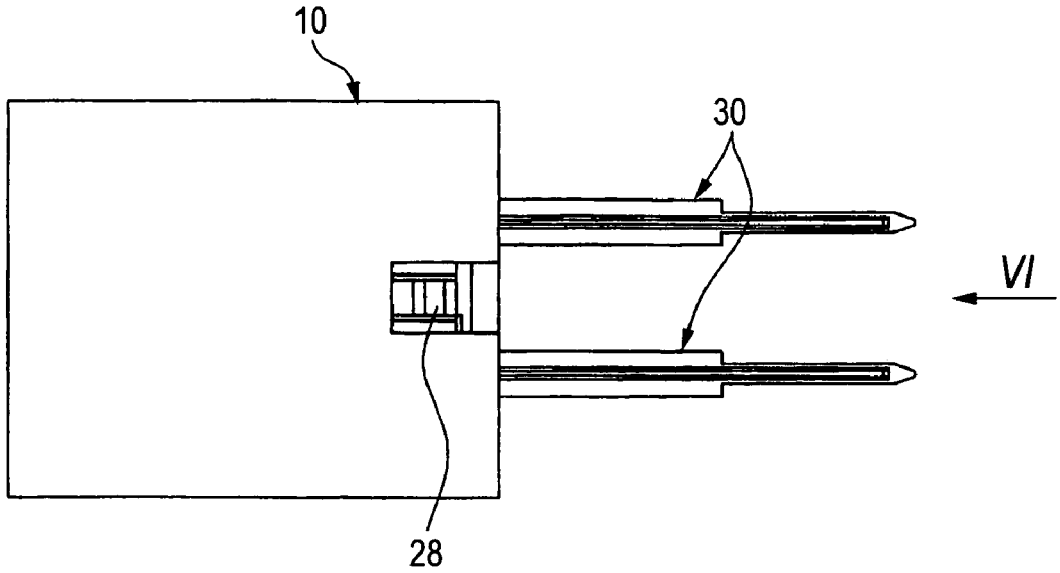
FIG. 4 is a view as seen in a direction of arrow IV of FIG. 3.
Figure 5:
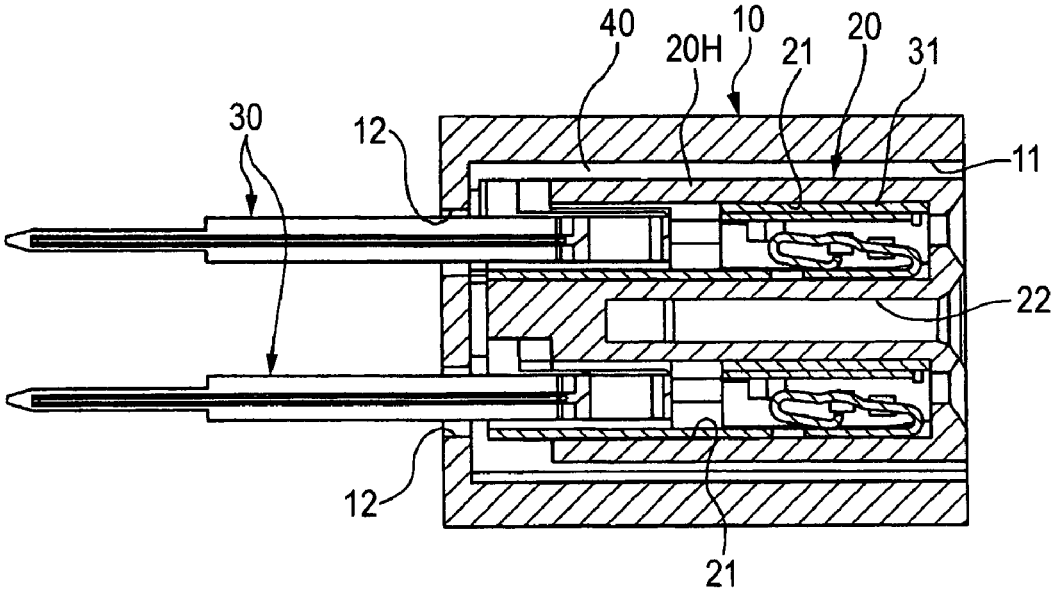
FIG. 5 is a cross-sectional view taken along the line V-V of FIG. 3.
Figure 6:
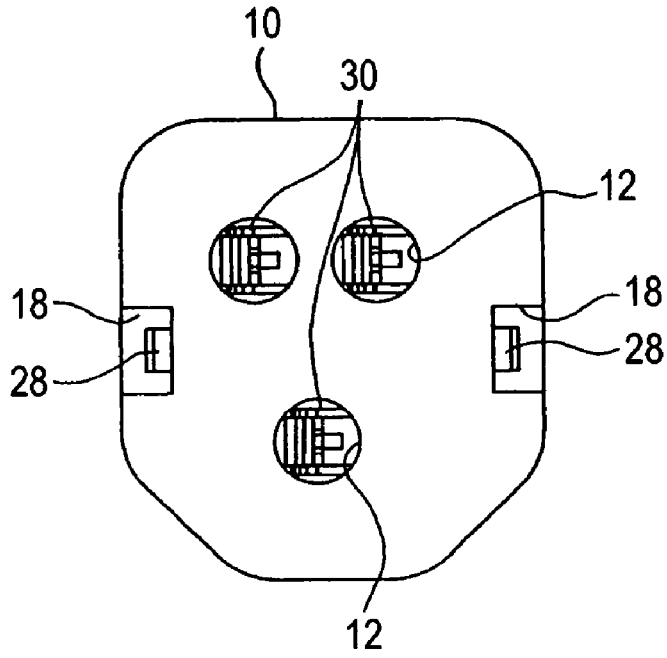
FIG. 6 is a view as seen in a direction of arrow VI of FIG. 4.
Figure 7:
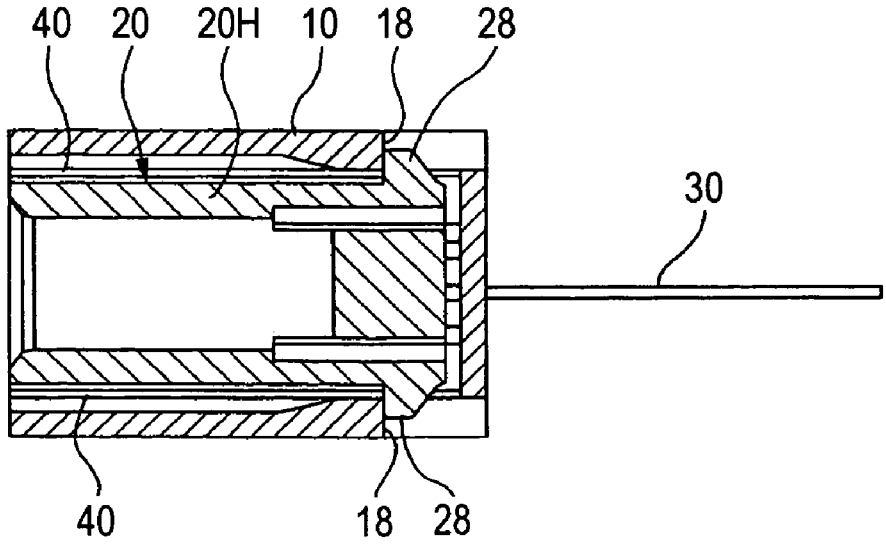
FIG. 7 is a cross-sectional view taken along the line VII-VII of FIG. 3.
Figure 8:
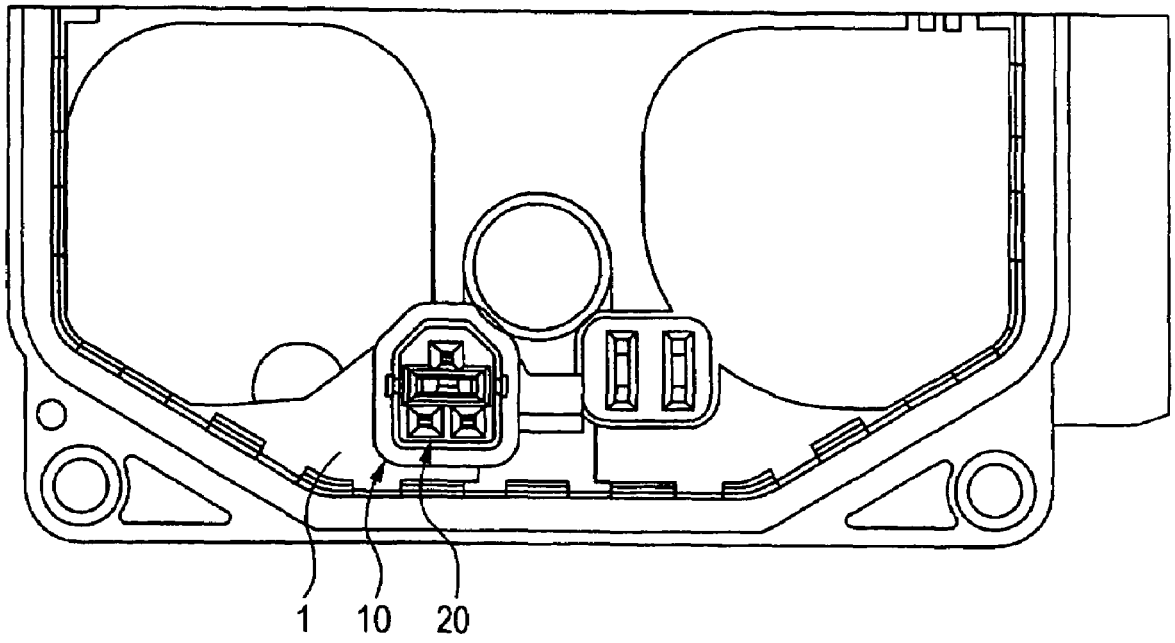
FIG. 8 is a front-elevational view of the case.
Figure 9:
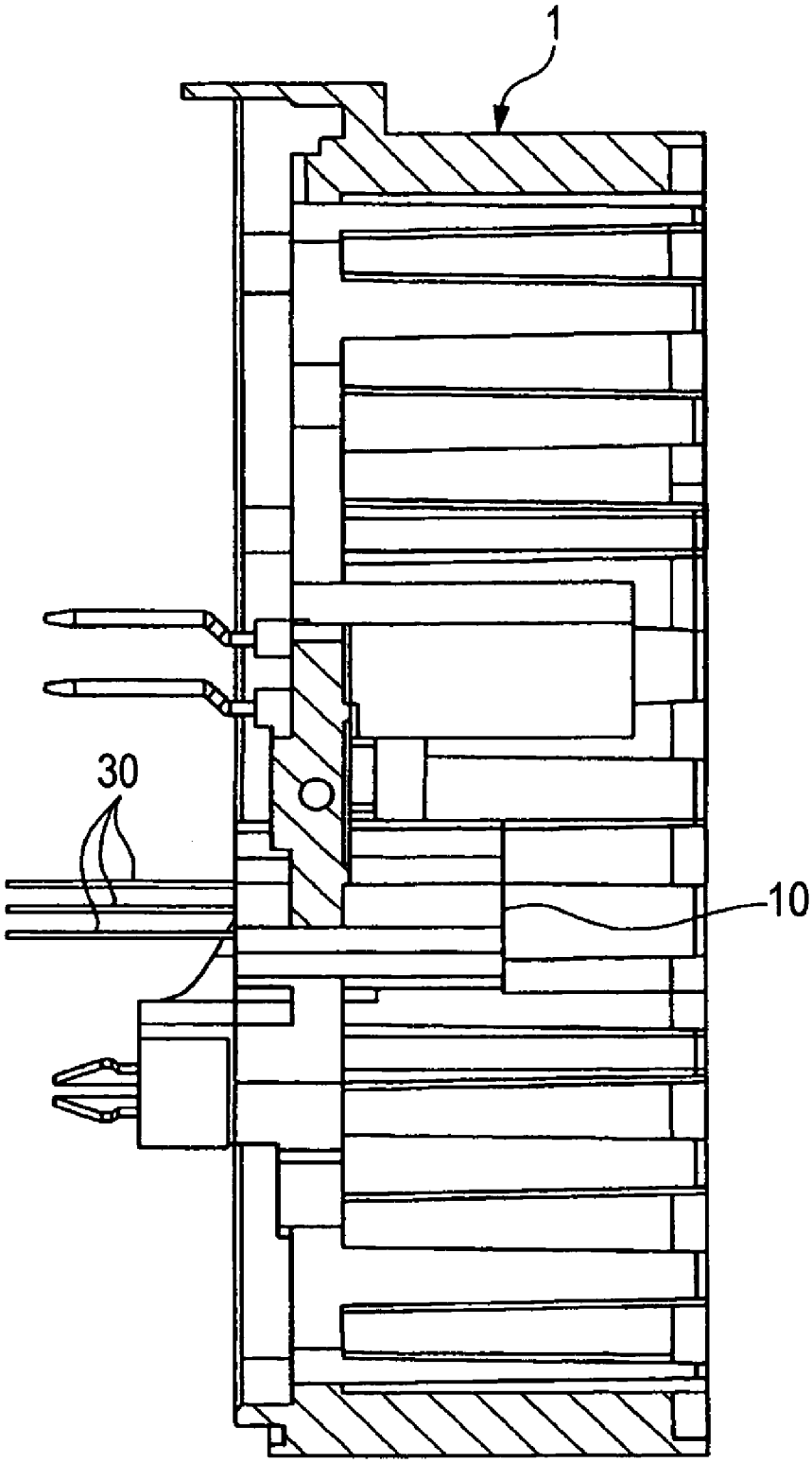
FIG. 9 is a cross-sectional view of the case.
Figure 10:
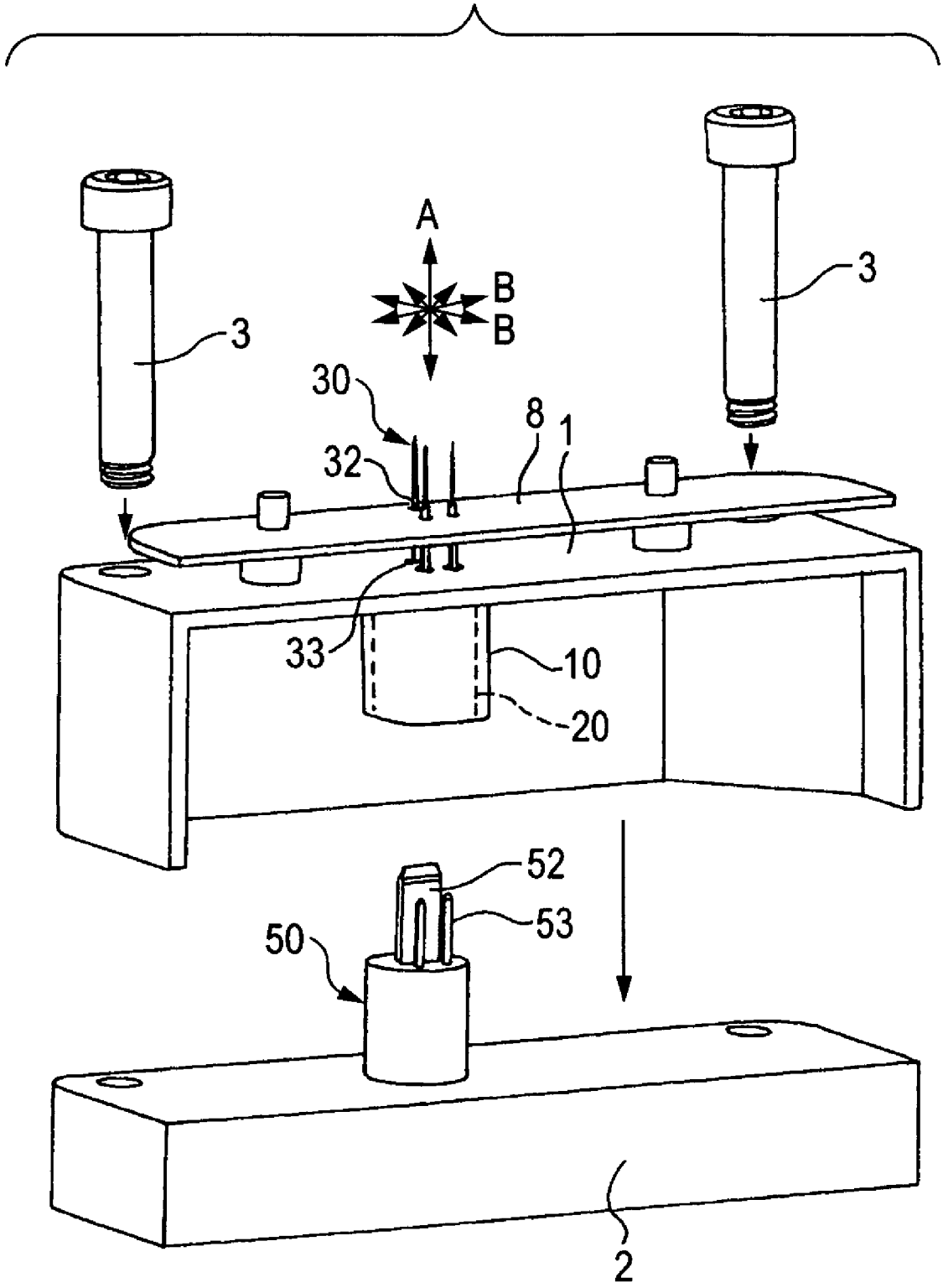
FIG. 10 is a perspective view showing a condition before the case and a unit (that is a first member) are fixed to each other.
Figure 11:
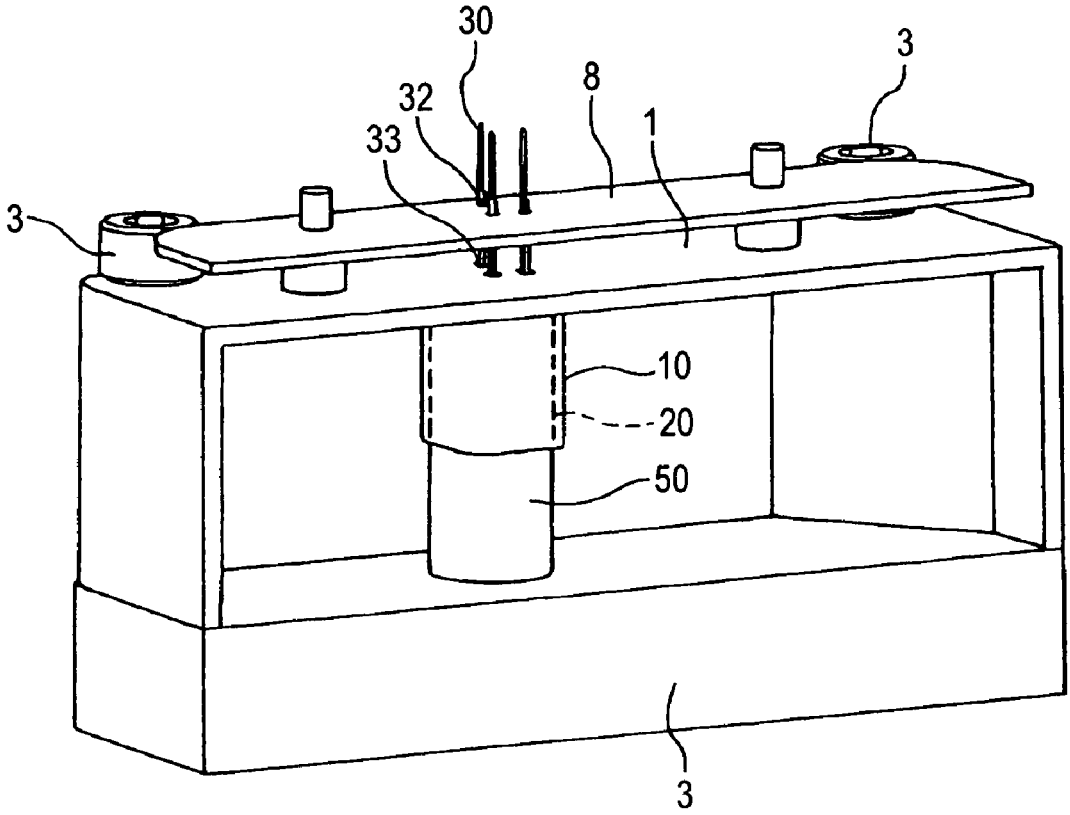
FIG. 11 is a perspective view showing a condition in which the case and the unit are fixed to each other.
Figure 12:
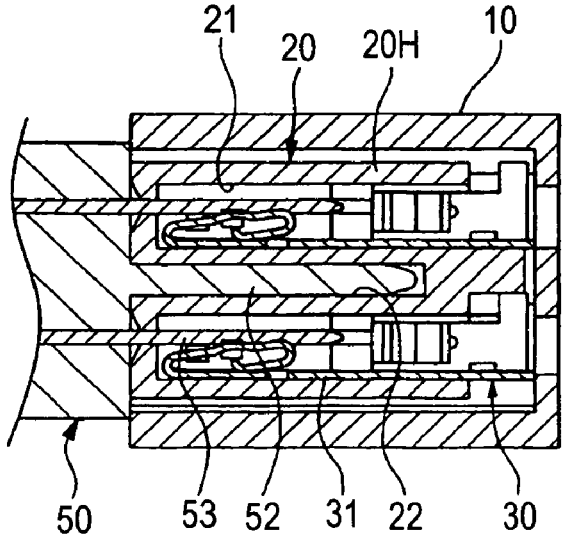
FIG. 12 is a cross-sectional view showing a fitted condition of the male and female connectors obtained when the case and the unit are fixed to each other.
Figure 13:
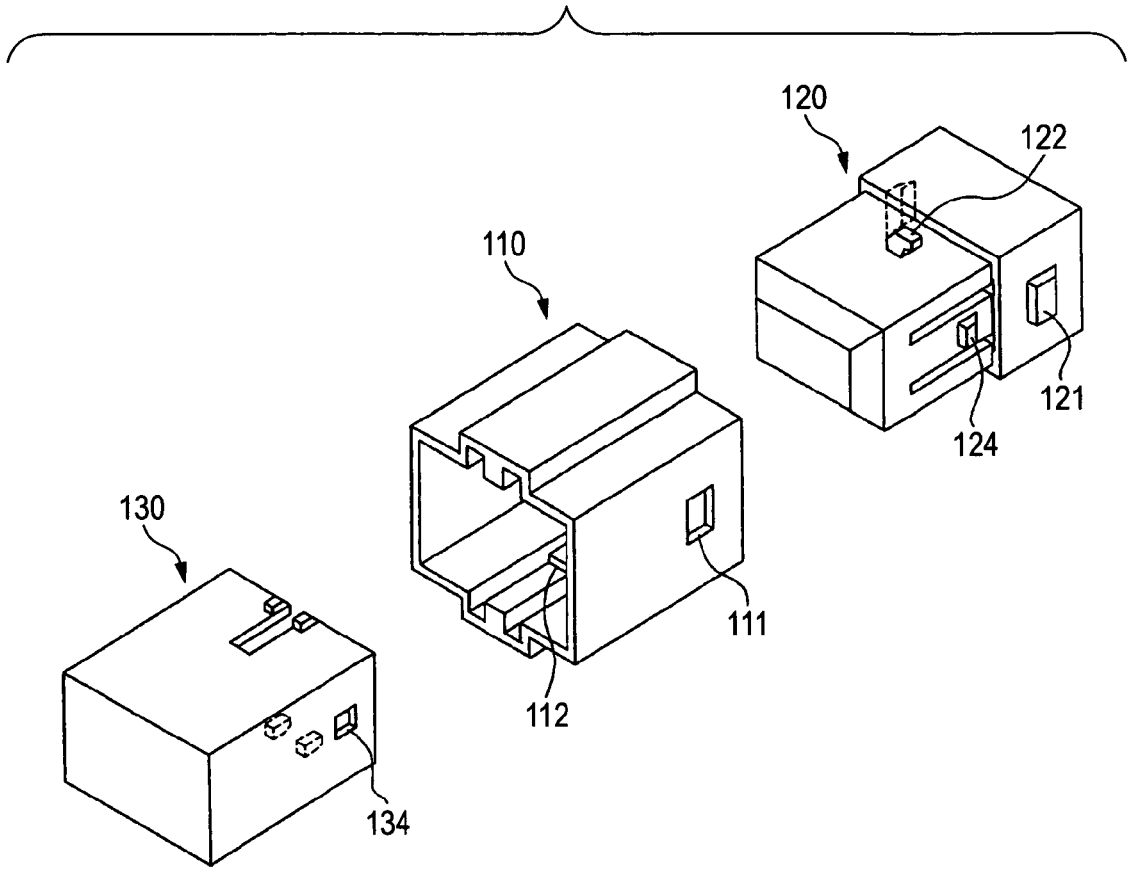
FIG. 13 is an exploded, perspective view of a related example.
Figure 14:
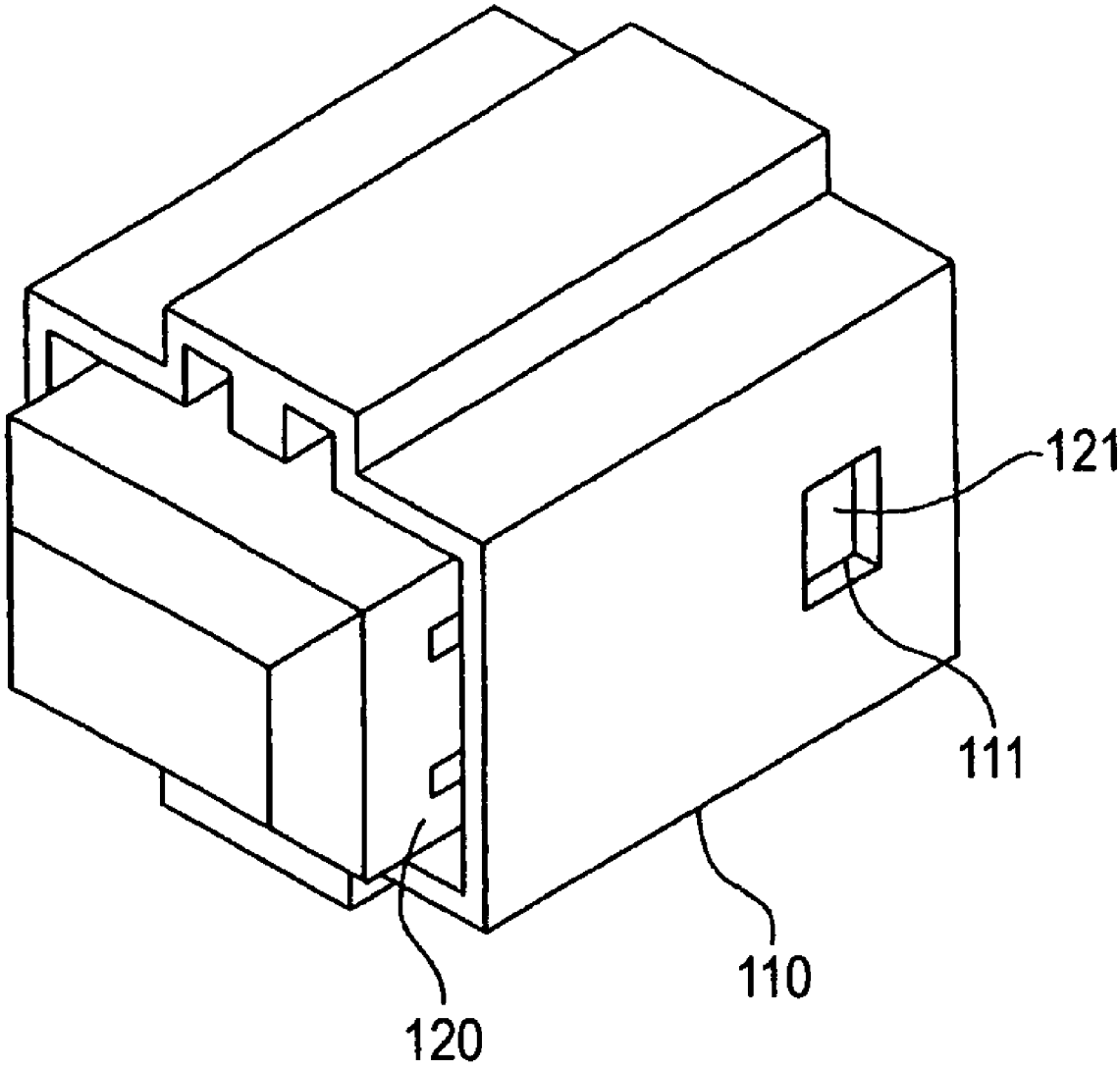
FIG. 14 is a perspective view of the related example, showing a condition in which a second connector is fitted in a holder.

FIG. 1 is an exploded, perspective view showing the relation between a case (second member), a holder and a female connector (second connector), FIG. 2 is a perspective view showing a condition in which the female connector is mounted within the holder, with the showing of the case omitted, FIG. 3 is a front-elevational view of the holder having the female connector mounted therein, FIG. 4 is a view as seen in a direction of arrow IV of FIG. 3, FIG. 5 is a cross-sectional view taken along the line V-V of FIG. 3, FIG. 6 is a view as seen in a direction of arrow VI of FIG. 4, FIG. 7 is a cross-sectional view taken along the line VII-VII of FIG. 3, FIG. 8 is a front-elevational view of the case, FIG. 9 is a cross-sectional view of the case, FIG. 10 is a perspective view showing a condition before the case and a unit (first member) are fixed to each other, FIG. 11 is a perspective view showing a condition in which the case and the unit are fixed to each other, and FIG. 12 is a cross-sectional view showing a fitted condition of the male and female connectors obtained when the case and the unit are fixed to each other.

As shown in FIGS. 10 and 11, one preferred embodiment of a movable connector of the invention includes the male connector (that is, the first connector) 50 fixed to the unit (that is, the first member) 2 which is one of the two members (that is, the resin-made case 1 and the resin-made unit 2) fixed to each other by bolts 3, the tubular holder 10 molded integrally on the case (that is, the second member) 1, and the female connector (second connector) 20 which is mounted within the holder 10 so as to move in a direction B perpendicular to an axis A of the holder 10, and is retained by a retaining unit (described later) against movement in the direction of the axis A of the holder 10. In accordance with an operation for fixing the unit 2 and the case 1 to each other, the male connector 50 and the female connector 20 are electrically connected together.

As shown in FIG. 1, the female connector 20 includes a female connector housing 20H having a plurality of terminal receiving holes 21, and female terminal portions 31 formed respectively at front ends of the terminals 30 are inserted respectively into the terminal receiving holes 21 from the rear side of the female connector housing 20H, and are retainingly held in the respective terminal receiving holes 21. Rear end portions of the terminals 30 extend rearwardly from the female connector housing 20H. The female connector 20 is inserted into the interior 11 of the holder 10 (formed integrally on the case 1) from the front side thereof. In this inserted condition of the female connector 20, elastic lock portions (that is, the retaining unit) 28, formed at the rear end of the female connector housing 20H, are engaged respectively in lock holes (that is, the retaining unit) 18 formed in a peripheral wall of the holder 10, thereby holding the female connector 20 against movement in the direction of the axis of the holder 10.

FIGS. 2 to 9 shows this condition, and in this condition a gap 40 is secured between the inner periphery of the holder 10 and the outer periphery of the female connector 20 (as shown in FIGS. 5 and 7) so that the female connector 20 can slightly move within the holder 10 in a direction perpendicular to the axis of the holder 10 (that is, in a direction parallel to the sheet of FIG. 3 which is a front-elevational view of the holder 10). Namely, any portion of the female connector 20 except the elastic lock portions 28 is hardly in contact with the holder 10. When the female connector 20 is thus inserted in the holder 10, the rear end portions of the terminals 30 of the female connector 20 extend rearwardly from the holder 10 through respective through holes 12 formed in the rear end of the holder 10, as shown in FIG. 5.

As shown in FIGS. 10 and 11, joint portions 32 for being joined to a circuit board 8 on a rear side of the case 1 are provided respectively at these rearwardly-extending portions through respective buffer portions 33 for absorbing displacement of the respective terminals 30 due to movement of the female connector 20 within the holder 10. In this case, the buffer portion 33 is formed by a narrow elongate portion intentionally provided between that portion of the terminal 30 inserted in the female connector housing 20H and the joint portion 32 for the circuit board 8.

The male connector 50, fixedly mounted on the unit 2, includes male terminals 53 for fitting into the respective female terminal portions 31 of the female connector 20, and a guide projection 52 projecting in a direction parallel to the male terminals 53, that is, in the connector connecting direction (that is, in a direction coinciding with the axis of the holder 10). A width of the guide projection 52 is substantially equal to a distance between two of the terminal receiving holes 21 in a direction perpendicular to the connector connecting direction. A guide hole 22 for the insertion of the guide projection 52 of the male connector 50 thereinto is formed in the female connector housing 20H. The guide projection 52 is slidingly fitted into the guide hole 22 and therefore the guide projection 52 and the guide hole 22 serve to guide the male and female connectors 50 and 20 for positioning purposes.

Next, the operation will be described.

When the case 1 and the unit 2 are fixed to each other by the bolts 3 while maintaining the predetermined positional relation therebetween, the female connector 20 held in the holder 10 on the case 1 is connected to the male connector 50, provided at the unit 2, in accordance with this fixing operation.

At this time, the female connector 20 is held within the holder 10 so as to move in a direction perpendicular to the axis of the holder 10, and therefore even if the two connectors 20 and 50 are disposed out of alignment with each other, that is, shifted relative to each other in a direction perpendicular to the axis of the holder 10, the female connector 20 within the holder 10 moves in accordance with the operation for connecting the female connector 20 to the male connector 50, thereby absorbing this misalignment, and therefore the two connectors 20 and 50 can be positively and easily fitted together.

And besides, when connecting the female connector 20 and the male connector 50 together, the guide projection 52 is slidingly fitted into the guide hole 22, thereby guiding the connection between the terminals 30 and the terminals 50. Therefore, the terminals 30 are prevented from striking against the terminals 53, and the terminals 30 can be smoothly fitted to the respective terminals 53.

Furthermore, the joint portions 32 for the circuit board 8 are provided respectively at the rear end portions of the terminals 30 of the female connector 20 through the respective buffer portions 33 for absorbing displacement of the respective terminals 30 due to movement of the female connector 20 within the holder 10, and therefore even if the female connector 20 moves so as to absorb misalignment, undue stresses will not act on the joint portions 32 of the terminals 30 for the circuit board 8, and the quality can be stabilized.

Furthermore, in this movable connector, the holder 10, holding the female connector 10 in a manner to allow the movement thereof, is molded integrally on the case 1, and therefore any time and labor are not required for mounting the holder 10 on the case 1, and therefore such additional step can be omitted. And besides, there is no need to prepare the holder 10 in the form of a separate member, and therefore the number of the component parts is reduced, and the cost can be reduced.

The present invention is not limited to the above embodiment, and suitable modifications, improvement, etc., can be made. Furthermore, the material, shape, dimensions, numerical value, form, number, disposition, etc., of each of the constituent elements of the above embodiment are arbitrary, and are not limited in so far as the invention can be achieved.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2005-334456 filed on Nov. 18, 2005, the contents of which are incorporated herein for reference.

What is claimed is:

1. A movable connector, comprising:

a first member;

a second member that is adapted to be fixed to the first member;

a first connector that is fixed to the first member, and includes a housing and a plurality of terminals which projects from the housing toward the second member;

a holder that is integrally formed on the second member; and a second connector that includes a plurality of terminal receiving holes and is provided within the holder so as to move in a first direction perpendicular to a second direction in which the first connector is connected to the second connector, wherein the first connector is connected to the second connector in accordance with an operation for fixing the first member to the second member;

wherein a guide projection is provided on one of the first connector and the second connector so as to project in the second direction; a width of the guide projection being substantially equal to a distance between two of the terminal receiving holes in the first direction;

wherein a guide hole is provided in the other of the first and second connectors and is arranged between the terminal receiving holes;

wherein the guide projection is longer than the terminal of the first connector; and wherein the guide projection is slidingly fitted into the guide hole so that the first and second connectors are guided to be positioned to each other.

2. The movable connector according to claim 1, wherein the second connector is provided within the holder so as to have an air gap between the second connector and the holder.

3. The movable connector according to claim 1, wherein a first retaining portion of the second connector is retained to a second retaining portion of the holder so as to restrict movement of the second connector with respect to the holder in the second direction.

4. The movable connector according to claim 3, wherein the second connector contacts the holder at only an area in which the first retaining portion is retained to the second retaining portion.

5. The movable connector according to claim 1, further comprising a terminal that is inserted in the second connector, wherein a rear end portion of the terminal includes:

a buffer portion which absorbs displacement of the terminal due to movement of the second connector within the holder; and a joint portion which is adapted to joint a circuit board.

6. The movable connector according to claim 1, wherein at least two of the terminal receiving holes are aligned with one another along a first direction and another one of the terminal receiving holes is spaced from the first direction and aligned at a position in between the at least two of the terminal receiving holes that are aligned along the first direction.

* * * * *